United States Patent [19]

Trimble

[11] Patent Number: 4,502,814

[45] Date of Patent: Mar. 5, 1985

[54] CONTINUOUS CRACK AND JOINT OVERLAY

[75] Inventor: David C. Trimble, Yorklyn, Del.

[73] Assignee: Hercules Incorporated, Wilmington, Del.

[21] Appl. No.: 446,522

[22] Filed: Dec. 3, 1982

Related U.S. Application Data

[63] Continuation-in-part of Ser. No. 242,085, Mar. 9, 1981, abandoned.

[51] Int. Cl.[3] ..... E01C 23/02

[52] U.S. Cl. ..... 404/107; 401/265; 401/266

[58] Field of Search ..... 401/265, 266, 261, 260, 401/139; 425/87; 404/100, 107, 108

[56] References Cited

U.S. PATENT DOCUMENTS

| | | | |
|---|---|---|---|
| D. 136,215 | 8/1943 | Kaub | 401/266 X |
| 359,003 | 3/1887 | Baldwin | 401/260 |
| 1,038,180 | 9/1912 | Moreland . | |
| 1,407,949 | 2/1922 | Ritz . | |
| 1,635,624 | 7/1927 | Imset | 401/266 |
| 2,104,086 | 1/1938 | Lines | 425/87 |
| 2,300,398 | 11/1942 | Ames | 72/130 |
| 2,630,006 | 3/1953 | Leach | 401/265 X |
| 2,727,266 | 12/1955 | Smith et al. | 15/131 |
| 2,882,716 | 4/1959 | Anderson | 72/130 |
| 3,020,813 | 2/1962 | Gross | 404/107 |
| 3,130,652 | 4/1964 | Newton, Sr. et al. | 404/107 |
| 3,133,300 | 5/1964 | Schnurmacher | 15/236 |
| 3,145,413 | 8/1964 | Alsleben | 15/595 |
| 3,227,055 | 1/1966 | Glade | 404/107 |
| 3,280,710 | 10/1966 | Glade | 404/107 |
| 3,334,792 | 8/1967 | De Vries et al. | 222/289 |
| 3,403,960 | 10/1968 | Ballard et al. | 401/188 |
| 3,451,757 | 6/1969 | Stroud et al. | 401/139 |
| 3,768,939 | 10/1973 | Gramling | 401/265 X |
| 3,972,631 | 8/1976 | Huber | 401/265 |

FOREIGN PATENT DOCUMENTS

| | | | |
|---|---|---|---|
| 800707 | 9/1958 | United Kingdom | 401/266 |

*Primary Examiner*—Steven A. Bratlie
*Attorney, Agent, or Firm*—John E. Crowe

[57] ABSTRACT

A method for the deposition of filler materials in filling and overlay applications is disclosed in which there is provided a continuous forced flow of filler material from an external reservoir, which is released through an outlet positionable over a depression in a surface which has been prepared to be filled and overlaid with filler to fill the place of application and overlay the surrounding area. An apparatus for the deposition of such filler is also disclosed.

5 Claims, 1 Drawing Figure

CONTINUOUS CRACK AND JOINT OVERLAY

This application is a continuation-in-part of copending U.S. application Ser. No. 242,085, filed Mar. 9, 1981 now abandoned.

SUMMARY OF THE INVENTION

The present invention relates to the deposition of filler material in filler and overlay applications. In particular, the present invention relates to a method for the deposition of filler materials in filling and overlay applications, comprising the steps of positioning an outlet means provided with a forced flow of filler material in a flowable state from an external reservoir over a depression to be filled in a surface, such that the forced flow issuing from said outlet means is directed into said depression, and over the surrounding area.

BACKGROUND OF THE INVENTION

In highway surfacing or resurfacing operations, any surface depression or irregularity, such as cracks and joints and the like, must be prepared for surfacing by cleaning and filling with some type of filler material. Until relatively recently, this was done with the same type of material as the surfacing material and was typically done in the same operation. However, filling irregularities in this manner often resulted in weaknesses in the finished surface at such points, and repair to the surface was often necessary within a short period of time.

In recent years, it has been found that the necessity for such repairs may be reduced by the overlayment of an impregnated fiber mat between the filled irregularities and the surfacing material. The application of such a mat, however, is at best a multiple stage operation and its use has been somewhat limited because of the problems and expenses involved. In such an operation, the area to be filled must first be opened and cleaned of debris, as is done in the filling method previously described. Then the area is filled with a conventional filler material such as hot asphalt, up to the level of the surrounding area. The surface of the filled area is then treated to promote bonding and a fiber mat which has been previously impregnated, or which is impregnated with an asphalt material as it is applied over the filled irregularity, is put down. The top surface of the impregnated fiber mat is then treated to bond to the surfacing material, and finally, the surfacing material is applied.

Aside from the expense of such a multi-stage operation, the procedure described is additionally disadvantageous in that after the application of the fiber mat, the surface cannot be traveled on until the top surface material is applied, and such application must be done within a short period of time. This often involves the coordination of the efforts of different contractors, and typically involves substantial delays.

OBJECTS OF THE PRESENT INVENTION

It is an object of the present invention to improve the repair of pavement surfaces by eliminating the expense and complexity of the application of impregnated fiber mats.

It is a further object of the present invention to eliminate the delays associated with the scheduling of the application of impregnated fiber mats by providing in a single application a filler and overlay layer which can be traveled on prior to the final surfacing.

It is a still further object of the present invention to provide a method and apparatus for the deposition of fiber filled asphalt matrix filler materials in filler and overlay applications.

The objects, features and advantages of the present invention are pointed out with particularity in the claims annexed to this specification. Finally, they will become more apparent in light of the following detailed description of the preferred embodiment thereof and is illustrated in the accompanying drawing.

According to the present invention, there is provided a method for the deposition of filler materials in filler and overlay applications comprising the steps of: positioning an outlet means including a circumferential spreading means provided with a forced flow of filler material in a flowable state from an external reservoir over a depression to be filled in a surface, and directing said forced flow of filler material into said depression and radially outward therefrom to form a layer overlaying the surface surrounding the depression.

According to another embodiment of the present invention, there is provided an apparatus for the deposition of filler materials in filler and overlay applications, which apparatus comprises: an outlet means provided with a forced flow from an external reservoir or filler material in a flowable state, said outlet means being positionable over a depression to be filled in a surface, such that the forced flow issuing from said outlet means is directed into said depression; and spreading means circumferentially surrounding said outlet means in a plane substantially parallel to the surface which spreading means is capable of also directing the flow of said flowable filler material radially outward to form a layer overlaying the surface surrounding the depression.

BRIEF DESCRIPTION OF THE DRAWING

The drawing illustrates the method and apparatus for depositing filler material according to the present invention.

DETAILED DESCRIPTION OF THE PRESENT INVENTION

Figure 1:
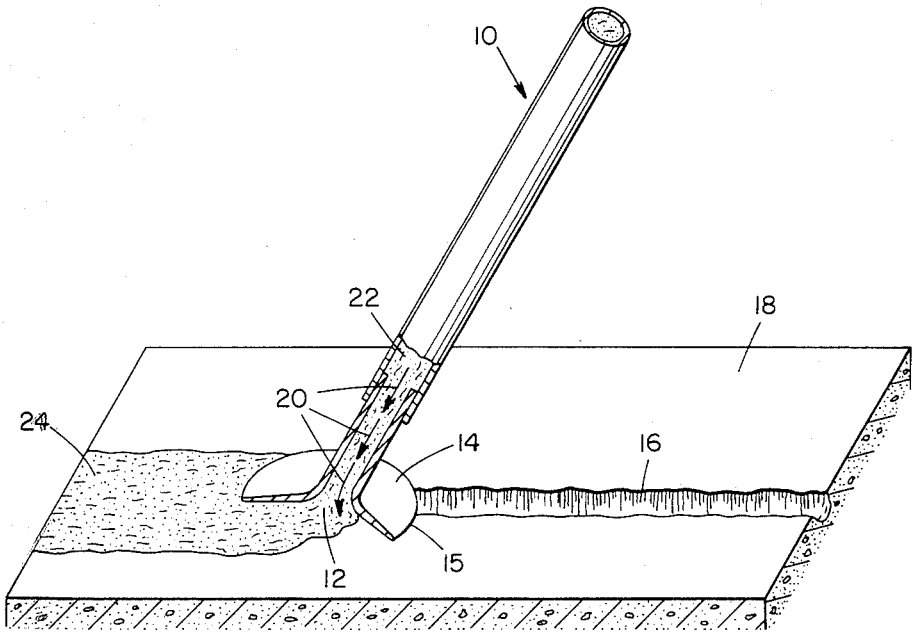

With reference to the drawing, apparatus (10) of the kind envisioned in the present invention is shown partly brokenaway in the drawing. The apparatus (10) is comprised of an outlet means (12) and a spreading means (14) circumferentially surrounding the outlet means (12) in a substantially horizontal plane. Such an apparatus is useful in filler and overlay applications, such as filling and overlaying surface depressions like holes, cracks, joints or similar irregularities in the surface prior to resurfacing.

In use, the apparatus (10) is positioned so that the outlet means (12) is placed over a depression to be filled, shown as (16), in a surface (18). The depression should have previously been prepared, as by opening the depression and removal of debris. A forced flow, represented by the arrows (20), of a filler material (22) is provided to the apparatus (10) and to the outlet means (12) from an external reservoir (not shown). The forced flow (20) is directed into the depression (16) through manipulation of the apparatus (10) by the user. The applicator or spreading means (14) also directs the flow of filler material (22) radially outward over the surface (18) in a layer (24) overlaying the surface (18) surrounding the depression (16).

In the drawing, the depression (16) to be filled in the surface (18) comprises a long, jagged crack which has been opened and cleaned in preparation. The method and apparatus of the invention are particularly suitable for the filling and overlayment of such a depression. Since the filler material, as shown in the drawing, is delivered in the center of the circumferential spreading means, the operator need merely position the device over the depression so that filler material is delivered directly into the depression. Excess filler overflows the depression and is directed radially outward over the surface in all directions. When filler emerges from under the edges of the spreader means, the operator moves the device along the length of the depression at the correct speed to assure that the depression is completely filled and overlaid to a consistent dimension. By controlling the rate of advance along the depression, the operator can readily provide a uniform surfacing over a crack of non-uniform width and depth. He can also move past the end of the crack, depositing a layer of the same width and thickness as the overlayment paralleling the crack.

The edges of the overlayment are not normally "feathered" or smoothed as this is difficult to do without causing clumping of the fibrous filler. It is convenient simply to have an abrupt termination of the overlayment which will be covered over by the finish coat which, in turn, will be leveled so that no evidence of the filled crack will show on the surface.

The particular use envisioned for the method and apparatus on the present invention is the use of polypropylene fiber filled hot asphalt or asphalt emulsion in filling and overlaying applications, although another suitable matrix material could be substituted for the asphalt. Likewise, another fibrous material, such as glass, asbestos, polyester or other fiber compatible with the chosen matrix could be used. A reservoir of hot asphalt containing, for example, 6 to 8 percent short cut reinforcing fibers, can be prepared and extruded under pressure into and over a depression using the apparatus shown in the drawing.

Other devices known for dispensing filler materials of the type contemplated herein containing reinforcing fibers deliver the material through an elongated nozzle wherein the material is constricted as it approaches the exit point, resulting in a substantially linear orientation of the fibers when the filler is ultimately deposited in the crack to be filled. Still other known devices deliver the filler through a relatively wide, narrow spreading and wiping device which likewise causes the fibers to be rearranged to a substantially linear orientation. The significance of the above is that, due to the predominantly linear orientation of the fibers in the filled composition which is deposited, the composition is reinforced in only the linear direction. Since the stresses which will be applied to it, e.g., in use as a paved surface, will act at least as much in the transverse direction the fibers are not capable of performing the function intended for them.

By contrast to the above, when the apparatus of this invention is employed to distribute a fiber filled asphalt composition, the radial or circumferential distribution pattern causes or permits to be retained a substantial portion of the random fiber orientation found in the filled asphalt matrix before it is deposited. The random orientation of the fibers between the linear and transverse directions results in reinforcement in both directions and entanglement of fibers. The result is a mat-like configuration of the fibers which imparts added strength to the asphalt layer in all directions.

The present invention is shown more clearly in the following illustrative example.

EXAMPLE

Four hundred pounds of molten Paving Grade AC 20 asphalt, commercially available from Atlantic Richfield Company, was put into a Crafco Model DC 220 crack sealer commercially available from Crafco Inc., Phoenix, Ariz. and stabilized to a temperature of 285° F. Then 28 pounds of 15 denier × 10 mm long polypropylene fibers from Hercules Incorporated under the trade name of Fiber Pave TM were added by pouring into the Crafco tank onto the molten asphalt.

The fibers were mixed into the asphalt to form a mixture of approximately 7 percent fiber by weight by running the Crafco agitator for two (2) minutes at 130 r.p.m. After this mixing, the agitator speed was reduced to 20 r.p.m. and run intermittently thereafter for ½ minute after each five (5) minute stoppage until the material was used up. Temperature of the mixture was maintained between 275° F. and 285° F.

The mixture was pumped through a 1" diameter by 18 ft. long reinforced rubber hose to the apparatus of the present invention by 2" Roper Gear Pump on the Crafco crack sealer.

A 9" diameter tip with ½" deep dome and central feed was guided along a crack ¾" wide × 2" deep keeping the outlet appreciably centered over the crack and moving at a rate of speed such that an overlay approximately 3/16" thick by 7" wide resulted above the filled crack.

An acceptable joint seal and overlay resulted.

Other features, advantages and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What I claim and desire to protect by Letters Patent is:

1. An apparatus for repairing cracks and depressions in a paved highway surface with a fiber-and asphalt-containing filler material, said apparatus comprising, in combination, an external reservoir for providing filler material in a flowable state;

outlet means receivably attached to said external reservoir for transmitting said filler material from said external reservoir;

inverted saucer-shaped spreading means circumferentially surrounding and flowably receivably attached to said outlet means for applying said filler material radially outward into and over the edges of said cracks and depressions to fill the same and form an overthrust or overlayment configuration;

whereby essentially random orientation of the fiber of said filler material is retained in passage of said filler material through said spreading means to provide improved shear and crack resistance to the repaired highway surface.

2. The apparatus of claim 1 wherein said spreading means is substantially flat at the bottom to discourage feathering of the filler material.

3. The apparatus of claim 1 wherein fiber in the filler material comprises at least one of polypropylene, glass, asbestos, or polyester fibers.

4. A method for improving shear and crack resistance of fiber- and asphalt-containing filler material for repair of cracks and depressions in paved highway surfaces, comprising applying said filler material into and onto said cracks and depressions to form an overthrust by utilizing, as applicator thereof an apparatus comprising, in combination, an external reservoir for providing fiber- and asphalt-containing filler material in a flowable state;

outlet means receivably attached to said external reservoir for transmitting said fiber- and asphalt-containing filler material from said external reservoir;

inverted saucer-shaped spreading means circumferentially surrounding and flowably receivably attached to said outlet means for applying said filler material radially outward into and over the edges of said cracks and depressions to fill the same and form the overthrust or overlayment configuration;

whereby essentially random orientations of fiber in said filler material is retained in applying said filler material through said spreading means.

5. A method of claim 4 wherein the fiber component comprises at least one of polypropylene fiber, glass, asbestos, or polyester fiber.

* * * * *

UNITED STATES PATENT AND TRADEMARK OFFICE

CERTIFICATE OF CORRECTION

PATENT NO. : 4,502,814
DATED : March 5, 1985
INVENTOR(S) : David C. Trimble

It is certified that error appears in the above-identified patent and that said Letters Patent are hereby corrected as shown below:

Column 2, Line 7 " Finally "

should read -- Further -- .

Signed and Sealed this

*Twenty-fifth* Day of *June 1985*

[SEAL]

*Attest:*

DONALD J. QUIGG

*Attesting Officer* *Acting Commissioner of Patents and Trademarks*